United States Patent [19]

Campbell et al.

[11] 4,273,836

[45] Jun. 16, 1981

[54] CORE STRIP BLANK, CORE STRIP AND METHOD OF MAKING SAME

[75] Inventors: James R. Campbell, South Laguna; Roy L. Anspach, Anaheim, both of Calif.

[73] Assignee: Thomas P. Mahoney, Balboa Island, Calif.

[21] Appl. No.: 948,011

[22] Filed: Oct. 2, 1978

[51] Int. Cl.[3] ..... B32B 3/04; B32B 3/10; B32B 3/28

[52] U.S. Cl. ..... 428/595; 428/126; 428/131; 428/182; 428/596; 428/604

[58] Field of Search ..... 428/116, 121, 126, 128, 428/130, 179, 182, 183, 185, 118, 119, 120, 131-136, 577, 578, 582, 593, 595-597, 599, 603, 604; 219/78.02, 78.11, 78.12, 81, 82

[56] References Cited

U.S. PATENT DOCUMENTS

| | | | |
|---|---|---|---|
| 1,042,885 | 10/1912 | Budd et al. | 428/122 |
| 1,444,103 | 2/1923 | Boyd | 24/23 W |
| 1,634,562 | 7/1927 | Shapiro | 313/276 |
| 1,876,519 | 9/1932 | McKinney | 428/122 |
| 1,908,863 | 5/1933 | Reid | 428/122 |
| 1,918,444 | 7/1933 | Bailey | 428/122 |
| 1,919,130 | 7/1933 | Reid | 428/122 |
| 1,921,484 | 8/1933 | Schlegel | 428/122 |
| 1,931,881 | 10/1933 | Bailey | 428/122 |
| 1,958,115 | 5/1934 | Schlegel | 428/122 |
| 2,038,278 | 4/1936 | Gibbs | 428/595 |
| 2,056,563 | 10/1936 | Budd et al. | 156/197 |
| 2,097,927 | 11/1937 | Klemp | 428/578 |
| 2,242,438 | 5/1941 | Rydquist | 428/122 |
| 2,273,099 | 2/1942 | Gilbert | 428/572 |
| 2,644,777 | 7/1953 | Havens | 428/116 |
| 2,719,809 | 10/1955 | Herts | 156/196 |
| 2,851,133 | 9/1958 | Steele | 52/666 |
| 2,910,153 | 10/1959 | Campbell | 428/116 X |
| 2,930,882 | 3/1960 | Campbell | 219/81 |
| 2,960,197 | 11/1960 | Langhans | 428/120 |
| 2,983,038 | 5/1961 | Johnson | 428/116 X |
| 2,987,611 | 6/1961 | Runkle | 219/78.12 |
| 3,015,715 | 1/1962 | Campbell | 219/78.11 X |
| 3,077,532 | 2/1963 | Campbell | 219/78.12 |
| 3,128,220 | 4/1964 | Gracer | 428/126 X |
| 3,283,118 | 11/1966 | Runkle | 219/79 |
| 3,341,395 | 9/1967 | Weber | 428/134 |
| 3,574,103 | 4/1971 | Latkin | 428/183 |
| 3,598,953 | 8/1971 | Campbell | 219/78.12 |
| 3,689,730 | 9/1972 | Campbell | 219/82 |
| 3,732,138 | 5/1973 | Almog | 428/71 |
| 3,774,365 | 11/1973 | Cole, Jr. et al. | 428/116 |
| 3,801,419 | 4/1974 | Meek | 428/182 |
| 3,830,684 | 8/1974 | Hamon | 428/132 |
| 3,834,962 | 9/1974 | Strumbos | 428/71 |
| 3,998,600 | 12/1976 | Wallis | 428/595 |
| 4,097,632 | 6/1978 | Minogue | 428/121 |
| 4,107,394 | 8/1978 | Almén | 428/595 |
| 4,144,369 | 3/1979 | Wass | 428/182 |
| 4,163,913 | 8/1979 | Barratt | 428/131 |
| 4,197,341 | 4/1980 | Rule | 428/182 |

FOREIGN PATENT DOCUMENTS

| | | |
|---|---|---|
| 561505 | 5/1944 | United Kingdom . |
| 604355 | 7/1948 | United Kingdom . |
| 607952 | 9/1948 | United Kingdom . |
| 631524 | 11/1949 | United Kingdom . |
| 866234 | 4/1961 | United Kingdom . |
| 1198809 | 7/1970 | United Kingdom . |

*Primary Examiner*—William J. Van Balen
*Attorney, Agent, or Firm*—Mahoney & Schick

[57] ABSTRACT

A core strip blank is characterized by the provision at its opposite edges of folds or doublers and the resultant core strip has the folded edges disposed substantially normally to the web of the core strip to provide surfaces for the securement of face sheets to the opposite folded edges of the core strip. The resultant core strip can be provided in a variety of configurations and may incorporate such openings or notches as will facilitate the deformation of the core strip into the desired configuration.

8 Claims, 14 Drawing Figures

12
14
10
12

42
42
40

16
18
90
18
16
20
90
20
18
16
10
22

44
44
46
48
50
46
48
40
50

18
20
22
26
22
20
10
90
18
10
16
23
18
22

46
40
50
46
52
48
44
43

34
32
36
26
34
32
20
18
22
20
16
18
26
30
22
20
18
22

52
64
46
52
48
50
64
46
50
48
46
44
62
46
50
60
46
48
62
50

CORE STRIP BLANK, CORE STRIP AND METHOD OF MAKING SAME

BACKGROUND OF THE INVENTION

Those skilled in the art are aware of the manufacture of composite panels including a central core structure which is provided with face sheets on the opposite surfaces thereof. Such panels and core structures therefor are shown in Campbell previously issued U.S. Pat. Nos. 2,930,882; 3,015,715; 3,077,532; 3,598,953; 3,689,730; and Johnson Pat. No. 2,983,038.

Campbell previously issued patents teach, among other concepts, the utilization of a core structure which consists of a plurality of internested core strips incorporating continuous flanges provided with male and female nodes adapted to internest with each other to provide a core of the desired area.

It is also known to provide core structures which include a plurality of core strips incorporating a series of tabs which are defined by a plurality of notches in the opposite edges of the core strip. Typical of the use of such notched core strip is the Johnson patent mentioned hereinabove.

Also known to those skilled in the art is the provision of panels of the Johnson-type wherein the apices of the corrugations of the core strips are notched to facilitate the deformation of the core strips into the corrugated configuration and the internesting of the core strips with one another. When such notched core strips are utilized, no attachment surfaces are provided at notched portions of the core strip for attachment to the inner surfaces of the juxtaposed face sheets of the panel. Consequently, the resistance of the resultant panel to flatwise tension is reduced by 15 to 20%.

The conventional process of forming core strip blanks initially entails the slitting of ribbons or strips of metal from relatively wide sheets of material. The slitting process results in the formation of minute cracks in the opposite edges of the resultant strip or ribbon and also causes the work hardening thereof which entails the necessity for an annealing process subsequent to the slitting of the blank.

However, even though the blank is annealed, microcracks remain in the opposite edges of the stainless steel materials utilized in the fabrication of the blanks, such as, Inco 718, 316, 347, 625, Rene 41, etc.

Consequently, when the blanks are subjected to the extreme deformation entailed by the internesting of the male and female nodes characteristic of the core structures of the aforementioned Campbell patents, the micro-cracks are greatly enlarged thus resulting in substantial reduction in the load bearing characteristics of the resultant core structure and possible cracking of the same when deformed in forming dies and/or subsequent handling.

Reference is made to our co-pending applications for U.S. Pat. Ser. No. 948,012, entitled Metallic Core Panel and Method of Making Same, filed Oct. 2, 1978, and Ser. No. 002,761, entitled Apparatus for Fabricating and Welding Core Reinforced Panel, filed Jan. 12, 1979.

OBJECTS AND ADVANTAGES OF THE INVENTION:

Our invention contemplates the manufacture of core strip blanks from previously slit stock having edges incorporating various imperfections, such as microcracks, wherein the edges are folded over to provide doublered flanges or portions.

Consequently, when the folded over edges are subjected to the subsequent step of deforming them into continuous or discontinuous flanges on the opposite sides of the intermediate web to constitute a core strip, the imperfections previously alluded to are no longer disposed at the edges of the flanges but inboard of the edges of the flanges in juxtaposition to or overlying relationship with the webs of the resultant core strips.

Therefore, when the folded over flanges are subjected to the relatively massive deformation accompanying the formation of the male and female nodes entailed in the utilization of the teachings of the Campbell patents alluded to hereinabove, the edges of the flanges presented for such deformation are smooth and characterized by the complete absence of fissures or cracks which could lead to subsequent failure of the core strips or the core fabricated by the utilization thereof.

A major advantage of the utilization of the core strip blank of our invention to fabricate core strip of various configurations is the elimination of the annealing step referred to hereinabove since the work hardened edge of the ribbon or strip from which the blank is formed is disposed inwardly of the resultant core strip edge and, therefore, is inoperative to deleteriously effect the physical performance of the core strip.

In order to insure maximum performance of blanks utilized in the prior art constructions as exemplified by the heretofore mentioned Campbell patents, the ribbons to be formed into core strips have been placed in a pickling solution after slitting in order to provide a radius on the opposite edges thereof and to eliminate therefrom, as much as possible, the stress concentrations present in the sharp square edge being elongated to form a female nodal flange.

The necessity for such a pickling step has been eliminated by our present invention because of the fact that the slit edge of the ribbon utilized to form the blank and the resultant core strip is no longer located in a zone of extreme elongation and the folded edge which is being elongated has a natural radius created by the fold.

The elimination of the significance of the work hardened edge of the ribbon utilized to form the core blank is particularly important in the case of titanium since the complicated annealing step in a vacuum furnace is eliminated.

It is, therefore, an object of our invention to provide a core strip blank characterized by the fact that the opposite edges of the blank are folded over to impart to the blank a doubler structure which provides on the edges of the blank a radius resulting from the method of creating the folded edges and which disposes the initial, impaired slit edges of the initial strip from which the blank is formed inwardly of the new radiused edge thereof.

An additional object of our invention is the provision of a blank of the aforementioned character wherein the inner edges of the folded or doubler portions of the blank are welded to the contiguous portion of the blank to secure them in operative relationship therewith.

A further object of our invention is the provision of a core strip fabricated from the aforementioned blank in which the doubler edges are bent over to provide a continuous channel defined by said bent or folded over edges and the remaining web of the blank. By bending or folding the doublered edge portions of the blank, a relatively thick and massive flange is provided which can be secured in operative relationship with the inner surfaces of the face sheets of a panel as by welding, diffusion bonding, brazing adhesives or the like.

By utilizing the core strip of our invention, a relatively thick flange is provided on the opposite edges of the core strip as constituted by the folded over or doubler portion of the core strip. This greatly enhances the physical performance of the joint between the core strip and the surface sheets in flatwise tension, flatwise tension fatigue, and core shear fatigue.

An additional object of our invention is the provision of a core strip of the aforementioned character wherein subsequent deformation of the core strip results in the corrugated configuration and alternate male and female nodes described in the aforementioned Campbell U.S. Letters Patent. When a plurality of such core strips are operatively internested with each other by cooperative relationship of the male and female nodes in the manner described in said patents, the structural strength of a resultant panel which consists of a face sheet or face sheets welded or otherwise secured to the doubler edges of the core strips is greatly enhanced because of the fact that there are triple layers of material provided where the flanges engage the face sheets and quintuple layers of material provided at the internested male and female nodes of the core strips and overlying face sheets. The resultant construction is characterized by substantially greater resistance to flatwise tension than the structures described in the aforementioned patents.

As previously mentioned, it is contemplated that alternative embodiments of the core strip of our invention be provided so that requisite physical characteristics may be achieved. For instance, in some applications, where the core strips are of corrugated configuration, openings or notches may be formed in the core strip at the nodal portions thereof to facilitate the achievement of the corrugated configuration of the core strip without the massive deformation entailed by the provision of male and female nodes on the core strip as previously discussed.

In prior art constructions where such openings or notches are provided at the nodal areas of the flanges, the resultant elimination of the flange continuum greatly reduces the performance of the resultant panel in flatwise tension by as much as 15 or 20%. However, by the utilization of the core strip of our invention the reduction of performance of the resultant panel in flatwise tension does not occur because of the fact that the doublers on the opposite edges of the core strip increase the performance of the resultant panel to an extent which more than obviates the effect of the notches at the nodal areas of the core strips.

The formation of the openings or notches can be achieved prior to the formation of the core strip into the channel-shaped configuration or subsequently thereto. For instance, the initial strip of material from which the blank is formed may be provided with circular openings adjacent the edges thereof prior to folding said edges to achieve the doubler effect.

When the edges are so folded, the circular openings are reduced to form semi-circular notches in the doublered edges which notches serve, in a manner to be described in greater detail hereinbelow, to facilitate the formation of the core strips into the desired corrugated configuration.

One of the advantages of the formation of the notches in the above described manner is that the circular openings can be fabricated by the utilization of sturdy, punch-type tooling which is longer lasting and more accurate than the tooling customarily used in the clipping operation entailed when the notches are formed in the edges of the doubler portion of the core strip blank after said doublers are formed.

Also within the scope of our invention are the various method steps utilized in fabricating the core strip blanks and core strips described hereinabove. It is, therefore, an object of our invention to provide a method of fabricating core strip blanks which includes a first folding step whereby the opposite edges of a strip of suitable material, such as stainless steel, titanium, or the like, are folded inwardly toward the center of the strip of material to provide doublers at the opposite edges of the strip of material.

Another object of our invention is the provision of core strip blanks having rows of notches in the opposite edges thereof by the steps of forming elongated lines of openings in parallelism adjacent said edges in suitable strips of material and subsequently reducing the size of said openings to provide notches in the edges of the resultant core blanks.

Another object of our invention is the provision of the method of the aforementioned character wherein the subsequent reduction of the size of the openings to provide notches is accomplished by the first folding step whereby the doublers are provided on the opposite edges of the core strip blank, the folding step creating a fold on a line which intersects the continuous rows of openings to provide said notches.

An additional object of our invention is the provision of a method of fabricating core strip blanks wherein the first folding step is accomplished by passing the strip of suitable material through a series of rollers whereby the doublers at the opposite edges have their inner surfaces engaging the contiguous portions of the blank and whereby a central web portion is permitted to remain between the edges of the doublers.

Another object of our invention is the method of forming a core strip which includes a first folding step for providing doublers on the opposite edges of a suitable strip of material and a second folding step whereby the doublers are folded angularly with respect to the intermediate web of the resultant core strip to provide a continuous channel between the continuous flanges constituted by said doublers.

An additional object of our invention is the provision of the aforementioned method wherein a subsequent step of deforming the channel-shaped core strip takes place to provide a corrugated configuration and alternate male and female nodes at the apices of said corrugations.

An additional object of our invention is the provision of a method of fabricating core strips which includes the steps of forming a continuous series of openings adjacent the opposite edges of a suitable strip of material; subjecting said strip of material to a first folding operation along a line located centrally of said openings to reduce the size of said openings and provide notches in the folded over portions of said strip; subjecting the resultant core strip blank to a second folding operation whereby the folded over edges are disposed in planes substantially normal to the plane of the centrally located web of the resulting core strip; and deforming said core strip into a desired configuration whereby the aforesaid notches are alternately reduced and expanded.

Also within the scope of our invention is the concept that, in the course of the first folding step, a bead may be formed at the folded edge of the doubler portions which is approximately one-third of to two times the thickness of the foil from which the core strip blank is formed. The bead prevents the edge fracture which might be caused by the first folding step and facilitates loading the core ribbons into the panel assembly fixture by providing a slight groove on the inwardly facing flange portions for reception of the core strip loading means, thus eliminating use of vacuum and/or force fits to maintain the core strip in proper position throughout the loading cycle of the core strip into the panel assembly apparatus.

Another object of our invention is the provision of a core strip which is characterized by the incorporation of the aforementioned doublers on the opposite flanges and which is also characterized by the provision of female and male nodes on alternate apices of the corrugations of the core strip. The core strip is further characterized by the fact that the flanges on the opposite edges of the strip are reduced to provide the male nodes alternately on the strip and incorporate slots which facilitate the deformation of the flanges at the male nodes to eliminate irregularities therein due to the impact of the die in the deformation process.

A further object of our invention is the provision of a core strip blank which is characterized by the fact that alternate notches are provided in the opposite edges of the core strip blank which results in the aforementioned core strip so that the resultant notched and unnotched male and female nodes, respectively, are achieved.

It will, of course, be obvious to those skilled in the art that a wide variety of materials running the gamut from the simplest, such as paper, to the most sophisticated, exotic materials, such as titanium, can be utilized in applying the teachings of the invention as they relate both to product and method.

For instance, the teachings of previous Campbell patents, referred to hereinabove, have been applied to stainless steel and titanium and it is conceivable that the present teachings may be applied, in the future, to alloys which as yet have not been created.

Other objects and advantages of the invention will be rendered apparent from the accompanying drawings and the description of the invention hereinbelow.

DESCRIPTION OF THE ILLUSTRATED EMBODIMENTS

Figures 1, 2, 3, 4, 5, 6, 7, 8:
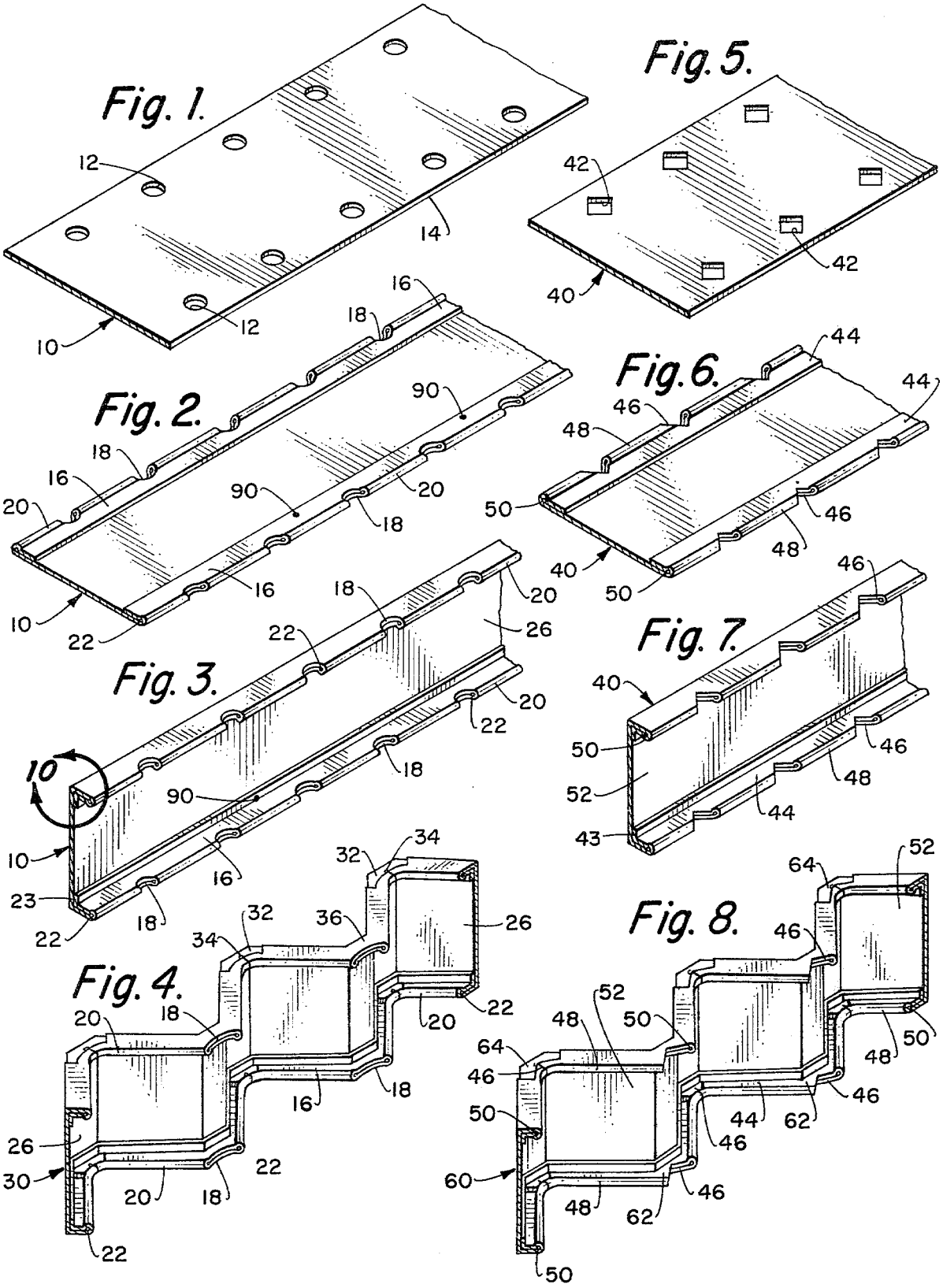
FIG. 1 is an isometric view of a core strip blank upon which the first hole forming step of the method has been performed.
FIG. 2 shows the blank of FIG. 1 after the first folding step has been performed.
FIG. 3 is a view showing the formation of the core strip by the second folding step from the blanks of FIGS. 1 and 2.
FIG. 4 is an isometric view showing a portion of the completed core strip after forming the strip into corrugated configuration.
FIG. 5 is a fragmentary isometric view showing a portion of an alternative form of core strip blank.
FIG. 6 is a view similar to FIG. 5 showing the modified core strip blank.
FIG. 7 is a view similar to FIG. 6 showing a core strip formed from the blank of FIG. 6.
FIG. 8 is an isometric fragmentary view showing the completed core strip and folded bead.

Referring to the drawings and, particularly, to FIGS. 1–4 thereof, we show a core strip blank 10 having a plurality of circular openings 12 formed therein adjacent the edges thereof, said circular openings being arranged in a straight line and being spaced inwardly of the edges 14 of the blank to facilitate the performance of the additional steps of the method.

The size and shape of the openings 12 are, of course, variable since it is conceivable that openings which are arcuately formed but, for instance, elliptical, may be provided in substitution for the openings 12. In addition, the edge distance between the outer perimeters of the openings 12 and the edges 14 of the strip blank 10 can be varied to space the outer perimeters of the openings 12 desired distaince from the edges 14 of the blank.

Since the perimeters of the openings 12 are continuous, they can be formed by the utilization of one or more conventional punches which, because of the fact that they are piercing on their entire periphery, are extremely durable and which can be maintained in optimum condition with a minimum of maintenance effort.

Of course, notches can be formed in the opposite edges of the doubler flanges of the core strip blank, by clipping or other techniques, if desired. However, the ultimate function of the notches is identical, that is, to facilitate the formation of the core strip into its corrugated configuration.

The material from which the core strip blank 10 is fabricated can be stainless steel whose dimensions may range in an order from 0.002" to 0.005". It can also be fabricated from various titanium alloys for high performance aircraft or aerospace applications.

In commercial applications, various types of straight chromium or carbon steel sheet may be utilized in substitution for the more exotic stainless steel and titanium alloys.

Because of the utilization of various steps of the method of fabricating the core strip blank from core stock, the blank material can be purchased slit to a desired width. The usual tolerance employed is about ±0.001 per inch of width. Consequently, the expensive precision slitting of the core stock required in fabricating the strip of the campbell patents is eliminated.

After the formatiion of the openings 12 by punching them in a continuous straight line in spaced relationship with each other and with the contiguous edges of the core strip blank, the core strip blank 10 is subjected to a first folding step which results in the provision of folded edges 16 to provide doublers, which simultaneously reduces the dimensions of the openings 12 to provide semi-circular notches 18 in the opposite edges of the blank 10. During the performance of the first folding step to which the blank 10 is subjected, a slight bead 20 may be formed at the edge of the fold which results in a continuous opening 22 encompassed by the bead 20.

The formation of the bead 20 eliminates the possibility that the edges of the folded over portions might be fractured when materials are utilized which are subject to excessive hardening or embrittlement.

Where more ductile materials are utilized, the bead 20 can be eliminated and a full contact fold can result from the first folding step.

Subsequently, the blank 10 is subjected to a second step, as best shown in FIG. 3 of the drawings, wherein the folded edges or doublers are subjected to a second folding or bending step which disposes the folded edges into planes substantially normal to the vertically disposed intermediate portion of web 26.

Furthermore, the inner edges of the doublers overlie the web 26, as at 23, FIG. 3. They may be secured to the web by a series of welds 90.

Folded edges 16, which form doublers, may be sized so that the inner edge of the doubler lies at the juncture of the flange and web wall and does not overlie the web wall. In this construction, the doubler would be welded to the primary flange rather than the web wall, if it were desirable to weld down the doubler.

Thereafter, the blank 10 of FIG. 3 can be formed by a subsequent step into the core strip 30 of FIG. 4 by imparting the sinuous or corrugated configuration to the core strip 30, the semi-circular notches 18 at the male nodes 32 of the core strip will be substantially closed with the exception of a relatively small orifice 34.

Portions of the male nodes 32 are deformed to permit them to be fitted within the corresponding female nodes 36. The provision of the notches 18 facilitates the deformation since there is no longer an excess of material encountered which impairs the surface of the deformed portions.

Of course, the notches 18 at the female nodes 36 are substantially expanded to permit the undeformed and unreduced portions of the male nodes 32 to be juxtaposed thereto.

Therefore, despite the presence of the notches 18 there is a substantial structural continuum in the flanges provided by the doublered edges 16.

An alternative configuration of the core strip blank is illustrated at 40 in FIG. 5 of the drawings as having a plurality of relatively square or rectangular openings 42 formed in the blank 40 in the same manner and relationship as the circular openings 12 of the blank 10. The blank 40 is subjected to the initial folding step which results in the corresponding folds or doublers 44 and the reduction of the dimensions of the rectangular or square openings 42 to provide V-shaped notches 46 in the edges of the blank 40. The bead 48 is also provided having the miniscule bore 50 provided therein to eliminate cracking of work hardened material.

Subsequently, the second folding or bending operation or step is imposed upon the blank 40, which results in the disposition of the folded edges in a plane substantially normal to the plane of the central portion 52 of the blank 40. The notches 46 are then disposed in a horizontal attitude.

The final step entailed in corrugating the blank results in the finished core strip similar of FIG. 8, wherein complete closure of the notches 46 occurs at the apices 64 of the corrugated strip 60, and substantial openings of the notches 46 occurs at the bases 62 of the corrugations to result in the male aspect of the apices 64 and the female aspect of the notches 46 at the bases 62 of the corrugations.

Although the formation of three configurations of openings, namely, circular, square or rectangular, has been disclosed, it will be obvious to those skilled in the art that various other configurations of openings can be utilized to impart the notch configuration to the opposite edges of the blank, and, ultimately, to the opposite edges of the core strip.

Figure 10:
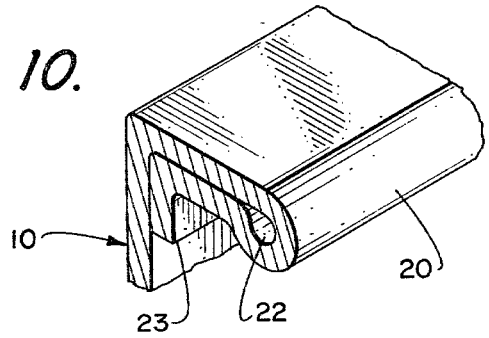
FIG. 10 is an enlarged fragmentary view taken on the broken line 10—10 of FIG. 3.

An enlarged detail is shown in FIG. 10 of the drawings to illustrate the formation of the bore or opening 22 by the formation of the bead 20 in the folded over portion of the blank 10.

Figure 11:
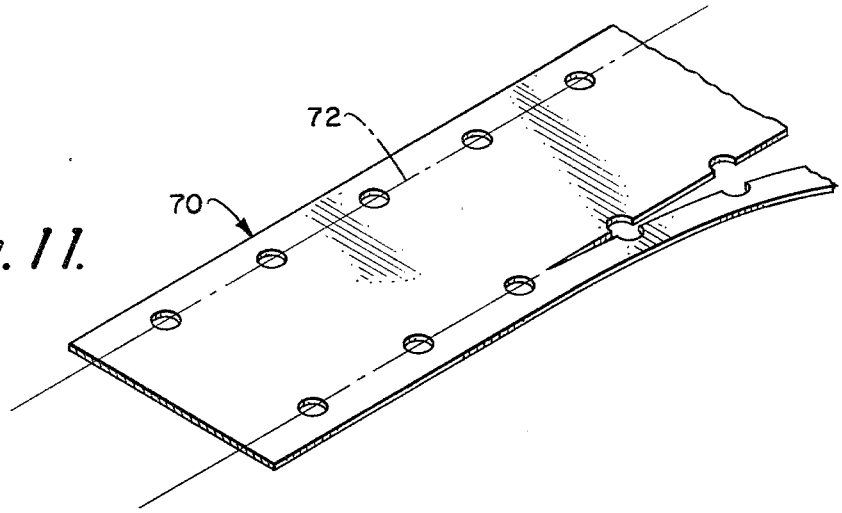
FIG. 11 is a view showing an alternative method of notch formation.

Of course, there are known to the art core strips wherein a series of single layer, right angular folds or tabs are provided on the opposite edges of the corrugated strips, as in Johnson, supra. If such a core strip configuration is desired with a single layer of material at the opposite bent over edges, the sequence of method steps detailed hereinabove can be modified by eliminating the initial folding over step, and by cutting a blank 70 along longitudinal lines 72, FIG. 11, to provide notches in the edges into the blank prior to bending or folding over the edges into the substantially normal aspect previously described.

Figure 9:
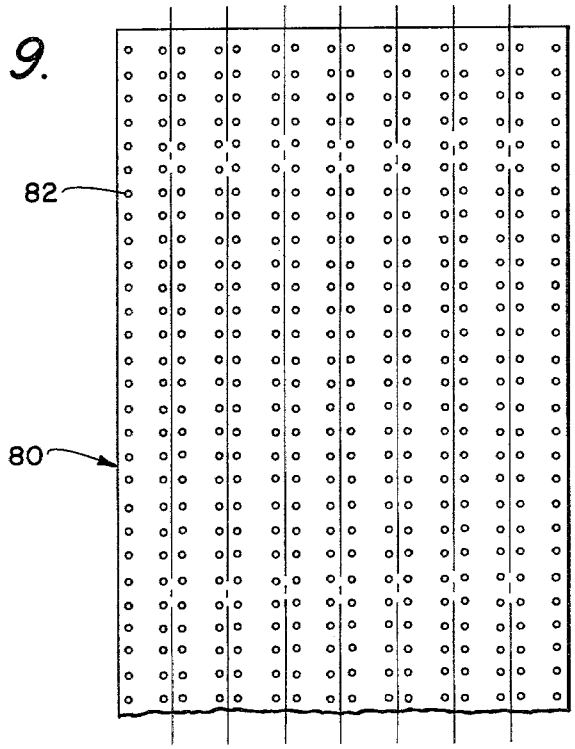
FIG. 9 is a view showing an alternative form of core strip blank.

While there has been discussed hereinabove the concept of providing a plurality of blank strips for initial formation of the various shapes of openings which result in the ultimate notch configuration of the relevant core strips, a large sheet of core material, as shown in FIG. 9 of the drawings, and designated 80, can be utilized in which a plurality of lines 82 of openings can be formed by multiple punch operations, or the like. Subsequently, the large sheets of material, which can be constituted by a continuous, wide strip of core material fed from a roll of the same, can be slit to provide the blank configurations, such as those of FIGS. 1 and 5, or configurations having the hole size and shape which are desired in the blank.

Consequently, it will be obvious to those skilled in the art that the formation of the core strip can result in the dual folded core strip of the character of the core strips 30 and 60 of FIGS. 4 and 8, respectively, or can result in a core strip of the general configuration of that disclosed in the Johnson patent, supra.

It will also be obvious to those skilled in the art that the formation of the notches by initially punching openings contiguous to the edges of the blank or in continuous lines in larger blank stock, can be eliminated by the clipping technique adverted to hereinabove. Furthermore, the double folding step results in the provision of triple layers of material at the interface of the double folds of the core strips, such as those of 30 and 60 of FIGS. 4 and 8, respectively, with a panel face sheet imparting greater structural strength and shear resistance.

In order to eliminate the possibility that, despite the provision of the bead 20 during the first folding step, a fracture might cause separation of the fold from the remainder of the blank, tack welds 90, as best shown in FIG. 2 of the drawings, can be provided which will insure that the physical securement of the folded edges to the remainder of the blank will continue until the resultant core strip is securely fastened, by welding or other means, in operative relationship with an associated face sheet. It is desirable that the tack welds 90 be located in the portions of the folds which overlie the web 26 of the resultant core strip as best shown in FIG. 3 of the drawings, when the folds overlie the web wall.

As previously indicated, instead of fabricating the core strip blanks with previously formed holes or openings, as is the case with the above described embodiments and method steps of our invention, it is possible to fabricate the blank and resultant core strip with continuous flanges similar to those provided in the above mentioned Campbell patents. The flanges are deformed to provide the cooperative male and female nodes and to impart the corrugated configuration to the core strip by the use of suitable dies or other tooling.

Moreover, it is also feasible to provide notches in a previously fabricated continuous core strip flange by the clipping method which entails the use of dies which cut the notches in the previously formed folded edges of the core strip blank.

In addition to greatly enhancing the physical characteristics of panel utilizing the core strip having the doubler portions, the doubler portions provide numerous other advantages which eliminate many prior art operations encountered with such devices as are taught in the Campbell patents. For instance, during the slitting operation occasioned by the formation of the Campbell strip material prior to the fabrication of the core strip blanks, minute cracks are formed along the strip edge which tend to develop into major cracks during the formation of the female node due to the extreme elongation of the material occasioned by the fabrication of the female nodes which is of an order of 60% or more. The slitting also work hardens the slit edge increasing the tendency of the edge to crack during deformation.

Consequently, after slitting the core strips, they must be strand annealled or pack annealled. As mentioned previously, titanium core strip ribbon can be vacuum annealled to eliminate a portion of the micro-cracks.

By eliminating the annealing steps alluded to hereinabove, the first folding step and resultant doubler edge construction of the core strip considerably reduces the expense of fabricating the core strip. This is due to the fact that the micro-cracks in the slit edge are disposed in overlying relationship with the web or contiguous area of the resultant core strip in locations where the elongation is negligible and the micro-cracks have no effect on the physical characteristics of the core strip and the resultant panel fabricated by the use thereof.

Another desirable result of the utilization of the folded or doublered edges is the fact that the rounded edges which must be provided by pickling and/or scarfing techniques on the slit edges of the prior art core strips can be eliminated since the provision of doublers on the edges of the core strip provides a rounded edge automatically and the sharp edges of the slit areas of the core strip are disposed in a zone of almost zero deformation when the corrugated configuration is imparted to the core strip.

While it is true that the doublered edge is work hardened and contains residual tensile stresses on its outer surfaces and residual compression stresses on its inner surfaces, these stresses are not additive to the massive elongation produced tensile stresses caused when the core strip blank is deformed into the corrugated configuration. This is attributable to the fact that when the stresses are created they occur at ninety degrees to each other.

One of the most desirable physical characteristics achieved by the doubler edge construction of the core strip of our invention is that the flatwise tensile strength of the doubler flange is much greater than the prior art single flange construction.

Failure of the joint between the flange and the face sheet occurs at the edge of the weld resulting in shearing the core strip from the weld. Where a single layer flange is provided on the core strip, as in the prior art Campbell patents, the resistance to the shearing action is much less than the resistance of the doubler flange of the present invention due to the fact that the weld extends through two layers of flange material thus greatly increasing the strength of the weld joint.

Moreover, the resistance of the panel incorporating core strips having doubler flanges to flatwise tension fatigue and core shear fatigue is greatly increased because of the reinforcing effect provided by the doubler flange.

Tests have shown, by way of example and illustration, that with a single thickness conventional flange, using Inco 625 foil 0.003 thick, the force per spot weld required to tear the flange vertically from the face sheet is about 9 to 12 pounds. With the doublered core, and all else remaining the same, the force is from 15 to 20 pounds.

Figure 12:
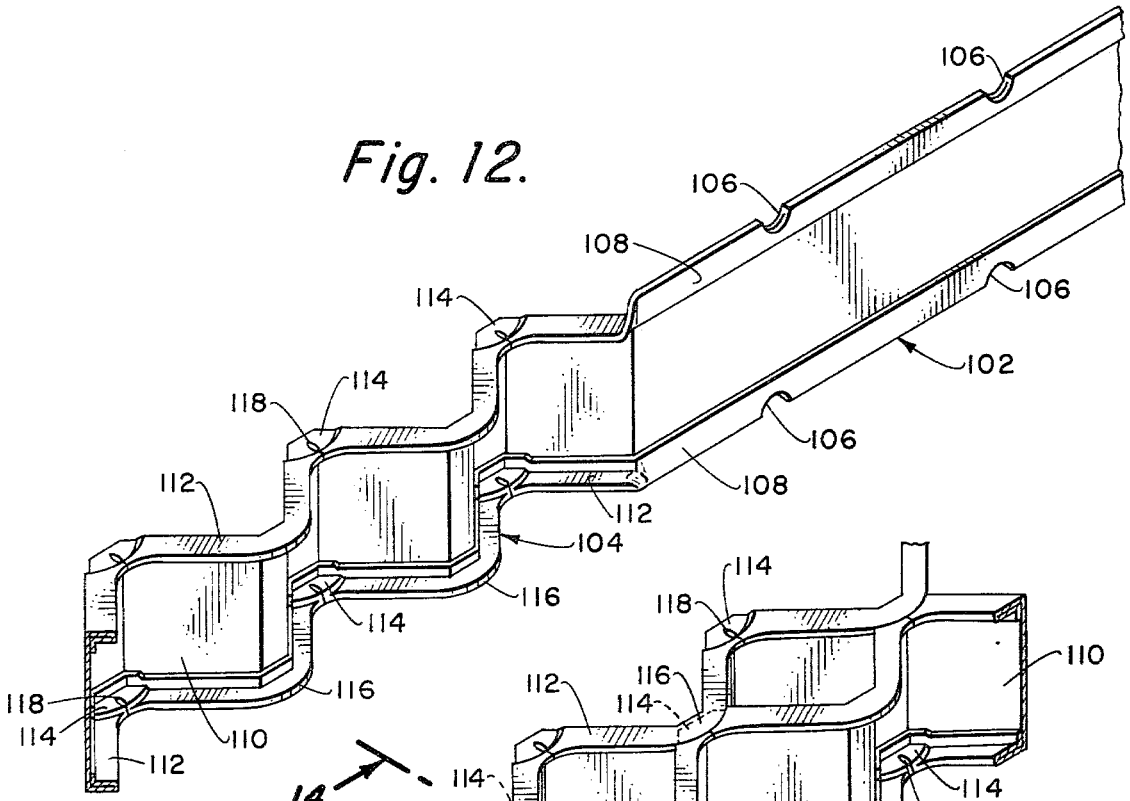
FIG. 12 is an isometric view showing an alternative form of core blank and core strip.
Figure 13:
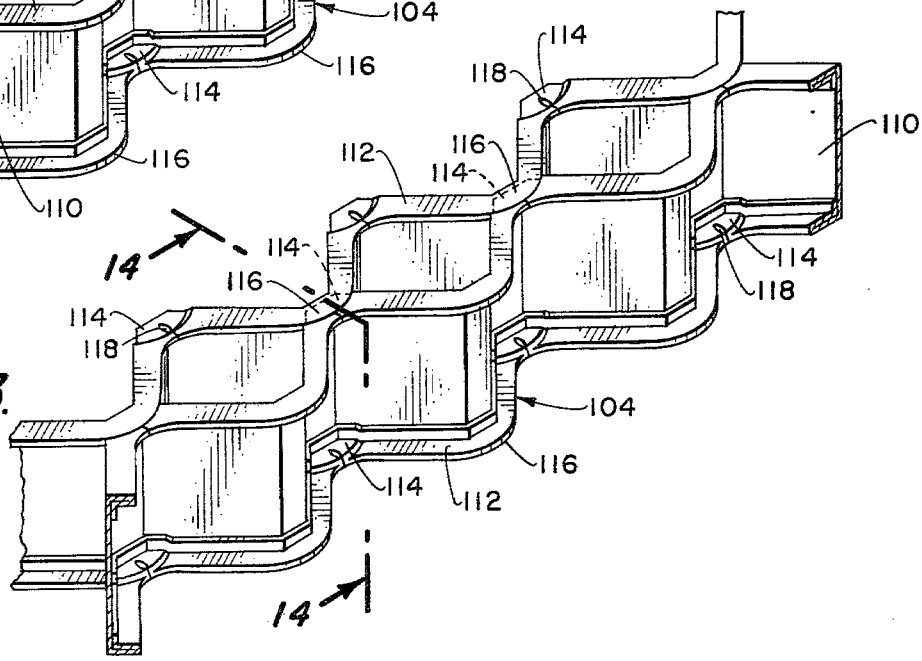
FIG. 13 is an isometric view showing the mating of the core strips of FIG. 12.
Figure 14:
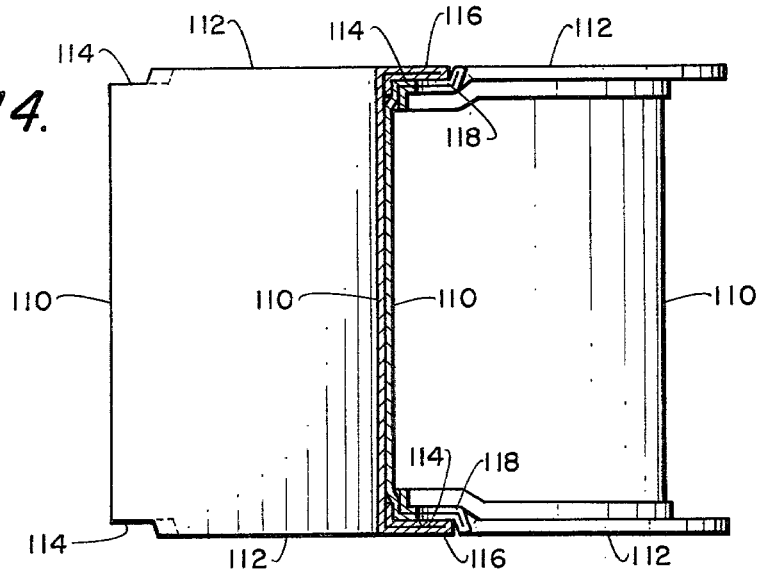
FIG. 14 is a vertical sectional view taken on the broken line 14—14 of FIG. 13.

Alternative configurations of core strip blank and core strip are disclosed in FIGS. 12–14 of the drawings wherein the core strip blank 102 is shown, FIG. 12, as being formed by a continuous die action into the core strip 104. The core strip blank 102 is characterized by the fact that notches 106 are formed in the doublered edges 108 of the blank by the clipping technique wherein the notches 106 are cut by punches in the doublered edges 108 after the formation of the doublered edges. In addition, the blank 102 is characterized by the fact that the notches 106 are spaced a greater distance apart than the continuous series of notches in the embodiments of the blank and core strip previously described so that notches 106 will only be found at alternate nodes of the resultant core strip 104 as described in greater detail hereinbelow.

The core strip 104 is of corrugated configuration and includes a web 110 having doublered flanges 112 on the opposite edges thereof. The core strip is provided with male nodes 114 and female nodes 116. The male nodes 114 incorporate the notches 106 which are reduced to a minute opening 118 during the deformation of the male nodes 114 to permit them to interfit with the female nodes 116 as best shown in FIG. 13 of the drawings. On the other hand, the female nodes 116 are not provided with notches but are merely permitted to assume the configuration shown in FIGS. 12–14 of the drawings during the corrugating process.

The provision of the notches 106 at the male nodes 114 eliminates the ridges and irregularities which would occur if the notches 106 did not accommodate for the deformation of the material at the male nodes. Therefore, a better interfit between the male and female nodes 114 and 116 is accomplished.

The manner in which the male nodes 114 interfit at the female nodes 116 is shown in FIGS. 13 and 14 of the drawings. The localized deformation of the male nodes 114 and the elimination of ridges at the point of localized deformation by the provision of the notches 106, facilitates the intimate engagement of the juxtaposed core strips 104. In addition, as best shown in FIG. 14, the interfit of the male and female nodes 114 and 116 provides four layers of material constituted by the doublers of the flanges 112 for the reception of a fifth layer of material constituted by the surface sheets, not shown, on each side of the panel in which the core is installed or constructed.

As previously indicated, the inner edges of the doublers overlie the web 26, as at 23, FIG. 3. While the inner edges of the doublers are shown as overlying a relatively small portion of the web, it is obvious that a greater length of material on the doublers will cause a greater overlying portion of each doubler to cover the web, if desired.

We claim:

1. A metallic core element for use in conjunction with a plurality of identical elements in fabricating a metallic core structure of honeycomb configuration including, an elongated, corrugated strip, said strip having a web with right angularly oriented upper and lower flanges thereupon with doublers disposed, respectively, in underlying relationship with said upper flange and overlying relationship with said lower flange, the corrugations of said strip providing alternate male and female nodes and said male nodes of one strip being fitted within the female nodes of an adjacent identical strip to provide a honeycomb core configuration.

2. A metallic core element of the character defined in claim 1 in which said doublers are defined by folded-over edge portions of said flanges.

3. A metallic core element of the character defined in claim 2 in which said folded-over edge portions of said flanges have extremities overlying adjacent portions of said web.

4. A metallic core element for use in conjunction with a plurality of identical elements to provide a metallic core structure including an elongated core strip having a web and upper and lower flanges on the opposite edges of said web, said upper and lower flanges having doublers thereupon, said core strip being corrugated to provide alternate male and female nodes thereupon, said flanges and said doublers being deformed at said male nodes to facilitate the insertion of said male nodes into corresponding female nodes of an adjacent core strip to define a honeycomb core structure.

5. A metallic core element of the character defined in claim 4, in which said core strip has said flanges and doublers notched at alternate nodes thereof to facilitate the formation of the corrugated configuration of said core strip.

6. A metallic core element of the character defined in claim 4, in which said doublers and said flanges constitute plural layers of metal secured in operative relationship with each other.

7. A metallic core element of the character defined in claim 4, in which said doublers are constituted by folded-over edge portions of said flanges.

8. A metallic element of the character defined in claim 4, in which said doublers have portions disposed in overlying relationship with said web.

* * * * *